US005844336A

United States Patent [19]

Ohya et al.

[11] Patent Number: 5,844,336

[45] Date of Patent: Dec. 1, 1998

[54] STARTER FOR AN INTERNAL COMBUSTION ENGINE

[75] Inventors: Masaaki Ohya, Isesaki; Koji Nara, Maebashi; Yoshikazu Sato, Fukaya; Michio Okada, Gunma; Shinichi Nagashima, Ashikaga, all of Japan

[73] Assignee: Mitsuba Corporation, Kiryu, Japan

[21] Appl. No.: 28,912

[22] Filed: Feb. 24, 1998

[30] Foreign Application Priority Data

Mar. 7, 1997 [JP] Japan ..... 9-053188

[51] Int. Cl.[6] ..... F02N 15/00

[52] U.S. Cl. ..... 310/80; 74/6; 74/76

[58] Field of Search ..... 310/80, 78, 83, 310/89, 87; 74/6, 7 R, 7 A, 7 C

[56] References Cited

U.S. PATENT DOCUMENTS

| | | | |
|---|---|---|---|
| 5,000,054 | 3/1991 | Morishita et al. | 74/6 |
| 5,048,355 | 9/1991 | Ueno | 74/7 A |
| 5,110,114 | 5/1992 | Isozumi et al. | 74/7 A |
| 5,167,162 | 12/1992 | Nagashima et al. | 74/7 A |
| 5,307,700 | 5/1994 | Spellman et al. | 74/7 A |
| 5,443,553 | 8/1995 | Shiga et al. | 74/7 R |

*Primary Examiner*—Nestor Ramirez
*Assistant Examiner*—Joseph Waks
*Attorney, Agent, or Firm*—Marshall & Melhorn

[57] ABSTRACT

In a starter (1) for an internal combustion engine including a planetary gear type reduction gear unit (2) and a housing (17) for accommodating at least the reduction gear unit (2), a recess (51) is formed at a lower part (17*a*) of the housing (17) in an installed state of the starter (1) in a manner that the recess (51) is formed in an inner periphery of the housing (17) so as to define a drain passage (51) extending substantially axially, and a part (52) of an outer periphery of a first annular member (12), which constitutes a part of the reduction gear unit (2), protrudes into the recess (51). Thus, the protruding part (52) of the outer periphery of the first annular member (12) forms a labyrinth structure in the drain passage (51) defined by the recess (51) formed in the inner periphery of the housing (17), to thereby effectively prevent water from entering the housing (17) through the drain passage (51) without substantially impeding the passage of water from the housing (17) to the outside. This protruding part (52) is integrally formed in the first annular member (12), and therefore no additional component parts are required to make the labyrinth structure.

6 Claims, 4 Drawing Sheets

STARTER FOR AN INTERNAL COMBUSTION ENGINE

TECHNICAL FIELD

The present invention relates to a starter for an internal combustion engine, and particularly to a starter having a drainage structure.

BACKGROUND OF THE INVENTION

Conventionally, various types of engine starters for starting an internal combustion engine are known. For example, in some of the engine starters, a pinion gear is integrally connected to a one-way clutch which is driven by a DC electric motor via a reduction gear unit consisting of a planetary gear device, and the internal combustion engine is started when a solenoid activated by an engine start switch signal causes, via a shift mechanism, the pinion gear to be displaced into mesh with a ring gear of the engine.

In such a starter as described above, because it is difficult to prevent water from entering a casing of the starter through an opening provided at its portion surrounding the meshing point between the pinion and the ring gear, or from being taken into the casing due to a negative pressure generated in the starter while the stopped engine is cooled down, a drain hole is provided to the casing of the starter. For example, the pinion gear, a shift chamber casing for accommodating the shift mechanism, and the motor and solenoid are arranged in this order from the ring gear side, with the drain hole formed in the shift chamber casing so as to favorably remove water which may enter the shift chamber casing from the side of the ring gear.

Such a drain hole is usually formed at a lower part of the starter in the state that the starter is mounted to the engine, and thus in the cases such as when the vehicle is washed or when the vehicle travels over puddles on a road surface, splashed water may enter the casing through the drain hole formed at the lower part of the starter. Therefore, it is desired to provide some protection against such intrusion of water from underneath the engine room. However, a complicated drainage structure for achieving such protection against intrusion of water would lead to the increase in the number of component parts and hence to the increase in the total cost of the engine starter. Further such component parts of the complicated drainage structure may accidentally drop off if they are attached independently.

BRIEF SUMMARY OF THE INVENTION

In view of such problems of the prior art, a primary object of the present invention is to provide an engine starter comprising a simple drainage structure which is effective not only in removing water from a casing of the starter but also in preventing water from entering the casing through the drainage structure.

A second object of the present invention is to provide such an engine starter comprising a simple drainage structure which can be achieved without increasing the number of component parts, is easy to assemble, and therefore is economical to manufacture.

According to the present invention, these and other objects can be accomplished by providing a starter for an internal combustion engine, comprising: an electric motor having a rotor shaft; an output shaft; a pinion fitted on the output shaft and coupled with said output shaft via a spline; a reduction gear unit for transmitting an output of the electric motor to the output shaft, the reduction gear unit comprising a sun gear which is formed in a part of the rotor shaft, a plurality of planetary gears meshing with the sun gear, and an internal teeth ring gear meshing with the planetary gears; shift means to drive the pinion into mesh with a ring gear of the internal combustion engine; a housing for accommodating at least the reduction gear unit, the housing having an opening facing the electric motor; a first annular member fitted into the opening of the housing, said internal teeth ring gear of the reduction gear unit provided along the inner periphery of the first annular member; and a recess formed at a lower part of the housing in an installed state of the starter in a manner that the recess is formed in an inner periphery of the housing so as to define a drain passage extending substantially axially, wherein a part of an outer periphery of the first annular member protrudes into the recess.

Thus, the protruding part of the outer periphery of the first annular member forms a labyrinth structure in the drain passage defined by the recess formed in the inner periphery of the housing, to thereby effectively prevent water from entering the housing through the drain passage without substantially impeding the passage of water from the housing to the outside. This protruding part is integrally formed in the first annular member, and therefore no additional, extra component parts are required to make the labyrinth structure.

According to a preferred embodiment of the present invention, a second annular member is disposed between the electric motor and the first annular member for separating the electric motor and the reduction gear unit from each other, and said protruding part of the outer periphery of the first annular member is formed with an extension axially extending toward the electric motor so as to cover a lower part of a joint between the first and second annular members. This is effective in preventing water in the drain passage from entering the inside of the starter through the joint.

Preferably, the starter further comprises a motor casing for accommodating the electric motor, and the motor casing is provided with a projection at a lower part thereof in the starter's installed state such that the projection contributes to preventing water's intrusion from outside into said drain passage formed in the inner periphery of the housing. According to a preferred embodiment of the present invention, said protrusion of the motor casing consists of a cap member for covering a drain hole which is formed at a lower part of the motor casing in the starter's installed state, and an outlet opening of said cap member and that of said drain passage defined by the recess are arranged such that they face each other.

In achieving such a structure, it is convenient that said housing comprises a projecting portion at a lower part thereof in the starter's installed state, and the recess defining the drain passage is formed in said projecting portion.

The first annular member integrally provided with such a protruding part in its outer periphery can be favorably made of synthetic resin material by molding.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
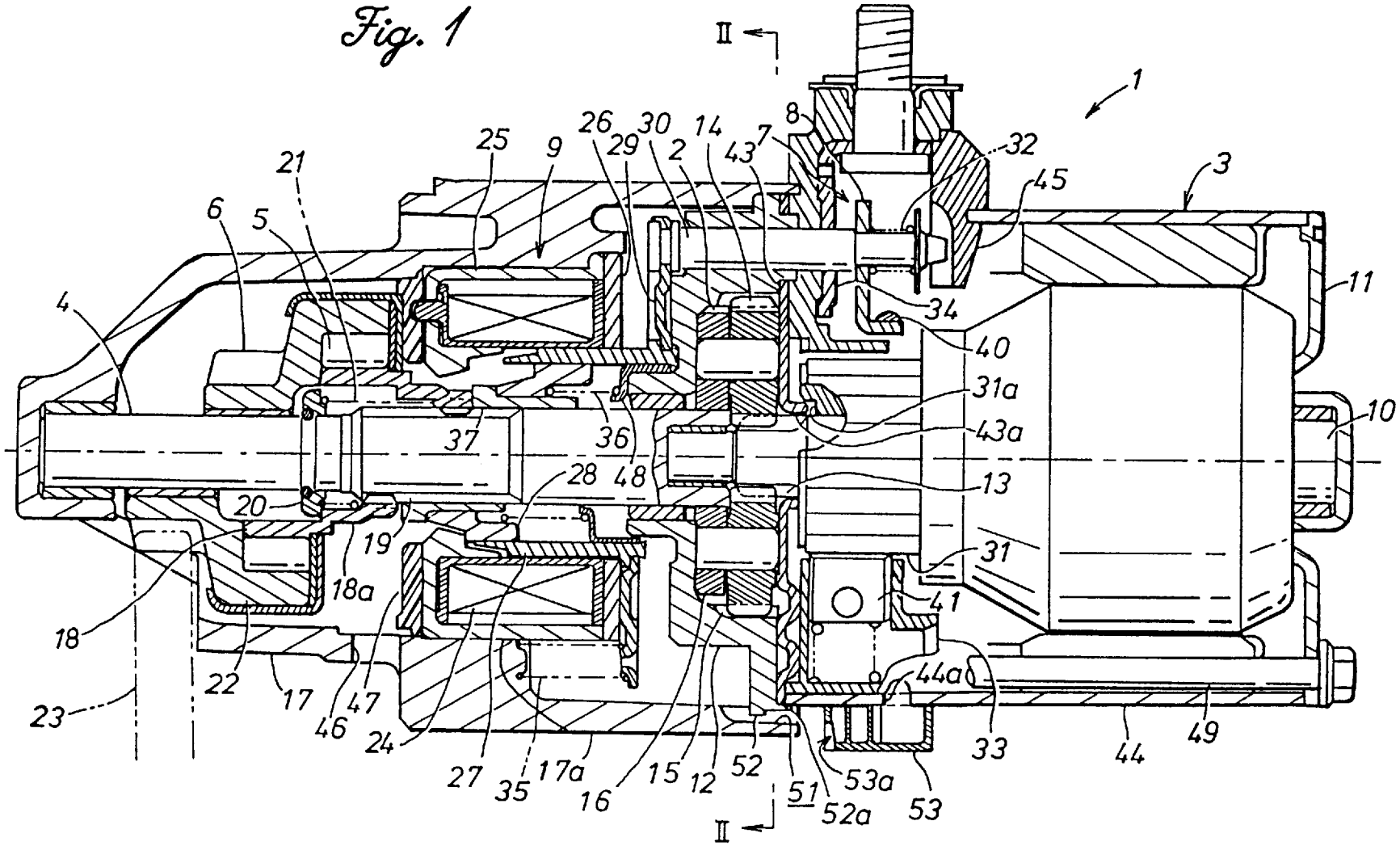
FIG. 1 is a sectional view of an engine starter according to the present invention, the engine starter equipped with a reduction gear unit.

FIG. 1 generally illustrates an engine starter constructed according to the present invention, where the engine starter is equipped with a reduction gear unit. The upper half of the drawing illustrates the starter at its inoperative state while the lower half of the drawing illustrates the starter at its operative state. It should be noted that in FIG. 1 the component parts are shown in their respective cross sections selected in view of clearer explanation, and therefore these cross sections are not necessarily in the same plane. This starter 1 produces a torque which is necessary for starting an internal combustion engine, and comprises an electric motor 3 equipped with a planetary gear reduction gear unit 2, an output shaft 4 connected to the electric motor 3 via the reduction gear unit 2, a one-way roller clutch 5 and a pinion 6 which are slidably mounted on the output shaft 4, a switch unit 7 for selectively opening and closing the electric power line leading to the electric motor 3, and a solenoid device 9 for axially moving a moveable contact plate 8 of the switch unit 7 as well as the pinion 6.

The electric motor 3 consists of a known commutator type DC electric motor, and its rotor shaft 10 is pivotally supported at a center of a bottom plate 11 at its right end as seen in the drawing, and pivotally supported at a center of a right end of the output shaft 4, which is coaxially disposed with respect to the rotor shaft 10, at its left end (on the side of the ring gear 23 of the engine) as seen in the drawing.

The reduction gear unit 2 comprises a sun gear 13 which is formed in a part of the rotor shaft 10 adjacent to the output shaft 4, a plurality of planetary gears 14 meshing with the sun gear 13, and an internal teeth ring gear 15 to mesh with the planetary gears 14. In this starter 1, the internal teeth ring gear 15 is formed along the inner periphery of a top plate 12 so that the top plate 12 is used as a ring gear member. The internal teeth ring gear 15 may be made separately from the top plate 12 as an independent annular member and fitted into the top plate 12. A support plate 16 supporting the planetary gears 14 is attached to the right end of the output shaft 4 (on the side of the electric motor 3) which is pivotally supported at the center of the top plate 12.

To the top plate 12 is attached a pinion housing 17 which also serves as a securing bracket for mounting the starter to the engine. The left end of the output shaft 4 is pivotally supported by a central part of the inner surface of the left wall of the pinion housing 17. As seen in the drawing, the left side part of the pinion housing 17 constitutes a chamber for accommodating the pinion 6, and the right side part of the pinion housing 17 forms a shift chamber casing.

The outer circumferential surface of a middle part of the output shaft 4 is provided with a helical spline 19, and an axial end portion of a sleeve 18*a* of a clutch inner member 18 of the one-way roller clutch 5 engages the helical spline 19. The clutch inner member 18 is normally urged to the right (the retracting direction) by a second return spring 21 interposed between the sleeve 18*a* and a stopper plate 20 secured to a left end portion of the output shaft 4. The second return spring 21 is received in an annular gap defined between the inner circumferential surface of the sleeve 18*a* of the clutch inner member 18 and the outer circumferential surface of the output shaft 4.

The tubular clutch inner member 18 engages a clutch outer member 22 of the one-way roller clutch 5 in an axially fast but rotationally free relationship. The clutch outer member 22 is provided with a tapered surface for defining a wedge chamber of the one-way roller clutch 5, and a part of the clutch outer member 22 adjacent to the ring gear 23 is provided with a projection directed to the end wall and the ring gear 23. The outer peripheral part of the projection is integrally formed with the aforementioned pinion 6 which meshes with the ring gear 23 of the engine to drive the same. The clutch outer member 22 integrally formed with the pinion 6 is fitted on the left end of the output shaft 4 in a both rotationally and axially free relationship.

In an intermediate part of the pinion housing 17 is secured an energization coil 24 which surrounds the output shaft 4 made of non-magnetic material. The energization coil 24 is surrounded by a yoke defined by a cup-shaped holder 25 through which the output shaft 4 is passed and an annular disk 26. In a gap defined between the inner circumferential surface of the energization coil 24 and the outer circumferential surface of the output shaft 4 is disposed an armature outer member 27 serving as a first plunger and an armature inner member 28 serving as a second plunger, both made of ferromagnetic material, in a mutually coaxial and axially slidable, telescopic manner. The left ends of the armature members 27 and 28 (the ends facing the pinion 6) oppose a projecting boss formed on the inner peripheral part of the holder 25 as a magnetic pole for the armatures 27 and 28.

An annular connecting plate 29 is fitted around the outer periphery of the right end of the armature outer member 27, and a connecting rod 30 which projects axially from an outer peripheral part of the connecting plate 29 is passed through the top plate 12 of the electric motor 3. To the projecting end of the connecting rod 30 is attached the moveable contact plate 8 of the switch unit 7 provided near a commutator 31 of the electric motor 3. The moveable contact plate 8 is mounted on the connecting rod 30 in an axially moveable manner, and is floatingly supported by a coil spring 32 in such a manner that it can be engaged and disengaged with and from a fixed contact plate 34 of the switch unit 7 which is fixedly secured to a brush holder 33 provided around the commutator 31. The armature outer member 27 is always urged to the right by a first return spring 35 interposed between the connecting plate 29 and the inner wall of the pinion housing 17, but is normally at its neutral position separating the moveable and fixed contact plates 8 and 34 from each other.

The armature inner member 28 is urged to the left in the drawing or toward the ring gear 23 by a coil spring 36 which is interposed between the armature inner member 28 and a spring retainer 48 made of non-magnetic material as spring means. The spring retainer 48 is fitted into a part of the inner bore of the armature outer member 27 adjacent to the electric motor 3. The armature inner member 28 is attached to a shifter member 37 which is made of non-magnetic material and has a left end abutting the right end of clutch inner member 18. The spring force of the coil spring 36 is weaker than that of the second return spring 21 provided on the clutch inner member 18 under the rest condition of the pinion 6, but becomes greater than that of the second return spring 21 before it is fully compressed by the armature outer member 27 which moves ahead of the armature inner member 28.

The energization coil 24 is electrically connected to an ignition switch not shown in the drawing via a connector provided in the switch unit 7. The fixed contact plate 34 of the switch unit 7 is electrically connected to the positive terminal of a battery not shown in the drawings, and a pair of pigtails 40 connected to a pair of positive pole brushes are attached to the movable contact plate 8 of the switch unit 7. A pair of negative pole brushes 41 are provided in a line-symmetrically opposing positions with respect to the positive pole brushes. These positive and negative pole brushes are received in their respective square-tube shaped brush holding frames which are formed integrally in the brush holder 33. The pigtails for these negative pole brushes 41 are connected to a center plate 43 which is described hereinafter, and are connected to the negative terminal of the battery via the pinion housing 17 and the vehicle body which is not shown in the drawings. The switch unit 7 is provided in a space flanked by the positive pole brushes.

The metallic annular center plate 43 is interposed between the brush holder 33 and the top plate 12 to separate the reduction gear unit 2 and the electric motor 3 from each other. From a central portion of the center plate 43 projects an annular boss 43*a* toward the commutator 31 so as to surround the outer periphery of the rotor shaft 10 defining a small gap therebetween. The free end of the annular boss 43*a* fits into a recess 31*a* formed in the axial end surface of the commutator 31 so as to prevent grease in the reduction gear unit 2 from leaking into the commutator 31.

The switch unit 7 is located in an upper portion of the starter 1, and the contact unit formed by the fixed contact plate 34 secured to the brush holder 33 and the moveable contact plate 8 is covered by the brush holder 33 and a cover 45 inside the motor casing 44 serving as a yoke. Thereby, brush dust is prevented from entering the contact unit of the switch unit 7.

The pinion housing 17 is provided with a drain hole 46 at a lower part thereof in the installed state of the starter 1. This drain hole 46 is provided near the seal plate 47 for determining the rest position of the pinion 6 as well as for repelling water. In the rest state of the starter the solenoid device 9 is sealed by the pinion 6 and seal plate 47 which are pressed against each other by the second return spring 21, but a space is created between the pinion 6 and the seal plate 47 once the pinion 6 has moved and meshed with the ring gear 23, and a gap between the outer peripheral surface of the clutch outer member 22 and the inner peripheral surface of the pinion housing 17 may permit intrusion of water. Even in such a case, the seal plate 47 works to block such water and removal of the water is favorably achieved by the provision of the drain hole 46 provided in front of the seal plate 47.

In the starter 1, in order to remove the water taken into a part of the pinion housing 17 which forms the shift chamber casing, a drain channel 51 is formed in an inner periphery of the opening of the pinion housing 17 adjacent to the motor 3 so that the drain channel 51 extends along the output shaft 4 or along the axis of the shift chamber casing at a lowermost part of the pinion housing 17 in the installed state of the starter.

Figure 2:
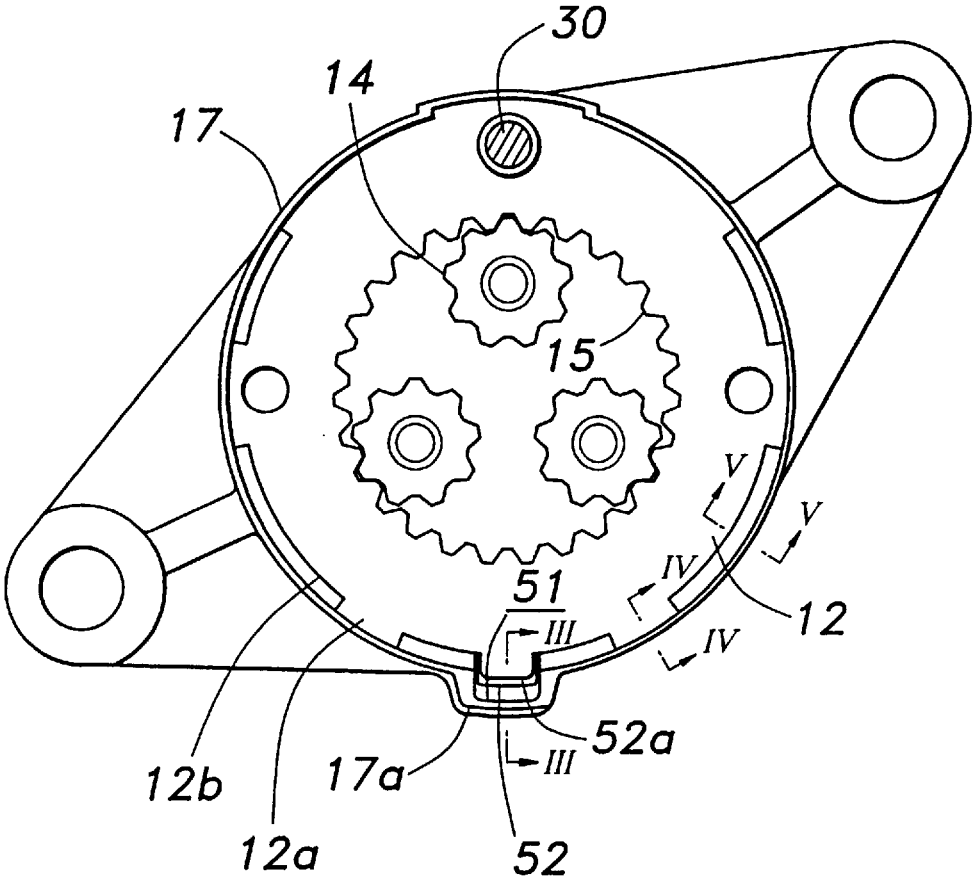
FIG. 2 is an end view of FIG. 1 seen along the line II—II.
Figure 3:
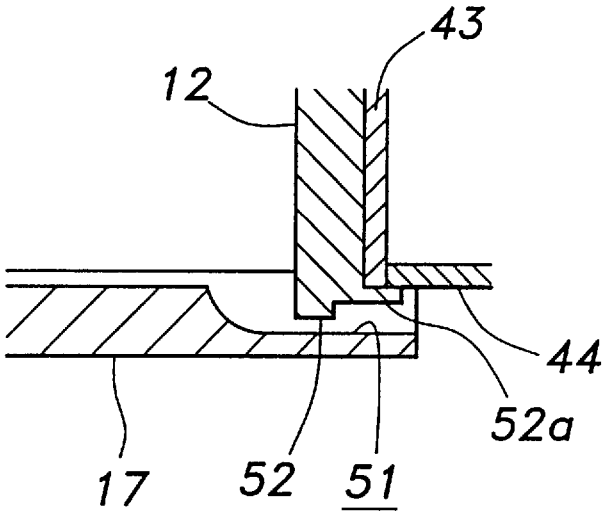
FIG. 3 is an enlarged sectional view of an essential part of FIG. 2 taken along the line III—III.

Further, as shown in the enlarged sectional views of FIG. 2 and FIG. 3, a protruding wall 52 is provided such that it extends from a part of the outer periphery of the top plate 12 toward the bottom of the drain channel 51. This protruding wall 52 occupies a part of the cross section of the drain channel 51 and, in the cases such as when the vehicle is washed or when the vehicle travels over puddles on a road surface, functions to prevent the intrusion of splashed water into the pinion housing 17 through the drain channel 51. The protruding wall 52 extends to such an extent that a space between the end surface of the protruding wall 52 and the bottom of the drain channel 51 can sufficiently permit passage of water from inside the pinion housing 17 to the outside.

The drain channel 51 and the protruding wall 52 can be integrally formed in the pinion housing 17 and the top plate 12, respectively, by molding. This eliminates the necessity of additional, extra component parts to form a drainage unit having a labyrinth structure as shown above, and thus can reduce the number of component parts. The labyrinth structure can be formed by merely assembling the pinion housing 17 and the top plate 12 in sequence, and this can reduce the manufacturing cost. The top plate 12 is favorably made of synthetic resin material so that the length and/or shape of the protruding wall 52 can be easily and precisely adjusted, although the top plate 12 may be made of metal or other suitable material.

Figure 4:
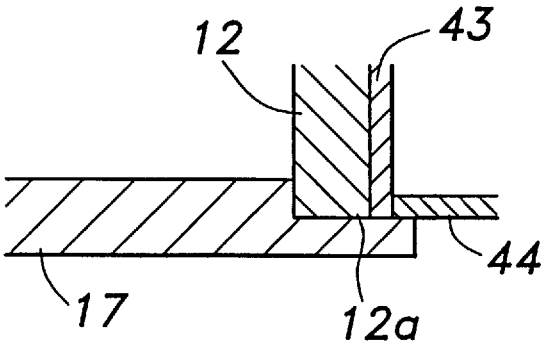
FIG. 4 is an enlarged sectional view of an essential part of FIG. 2 taken along the line IV—IV.
Figure 5:
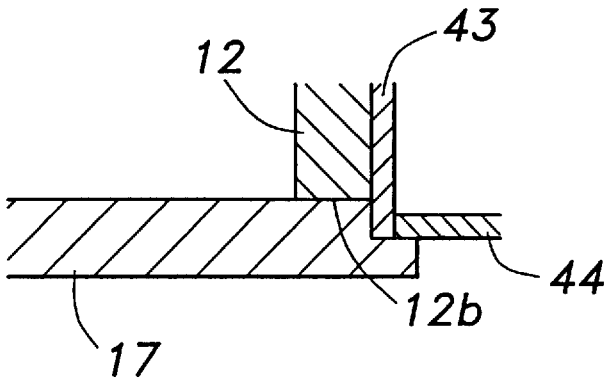
FIG. 5 is an enlarged sectional view of an essential part of FIG. 2 taken along the line V—V.

Also referring to FIG. 4 and FIG. 5, the configuration of top plate 12 and pinion housing 17 in their assembled state is described in the following. Portions of the inner bore of the pinion housing 17 into which the top plate 12 is fitted extend outwardly in the radial direction, and complementarily shaped protruding portions 12*a* and receding portions 12*b* are formed on the outer periphery of the top plate 12.

When the top plate 12 is assembled to the pinion housing 17, centering is achieved with the inner surfaces of the thick-walled portions of the pinion housing 17 abutting the outer surfaces of the recesses 12*b* of the top plate 12. The center plate 43 is then placed over the top plate 12. Subsequently, a through-bolt 49 is inserted through the bottom plate 11 and engaged into a threaded hole (not shown in the drawings) formed in the pinion housing 17 so as to axially secure the top plate 12 with the protruding portions 12*a* of the top plate 12 interposed between the center plate 43 and the corresponding shoulder surfaces defined by step-like portions formed in the pinion housing 17.

As best shown in FIG. 3, the protruding wall 52 has an extension 52*a* which protrudes along the axis of shift chamber casing or along the output shaft 4 toward the motor casing 44. The extension 52*a* covers a joint between the top plate 12 and the center plate 43, to thereby prevent the water in the drain channel 51 from entering the inside of the starter 1 through the joint. Preferably, as shown in FIG. 3, the extension 52*a* also covers a joint between the center plate 43 and the motor casing 44.

To a part of the motor casing 44 which is located at its underside in the starter's installed state and which is adjacent to the drain channel 51, is attached a drainage cap member 53 which is made of synthetic resin material by molding. It should be noted that although in FIG. 1 the brush holder 33 is shown at the lowermost position in the motor casing 44 for explanation, the brush holder 33 is actually placed at a position somewhat raised from the lowermost position in the state that the starter 1 is mounted to the engine.

Figure 6:
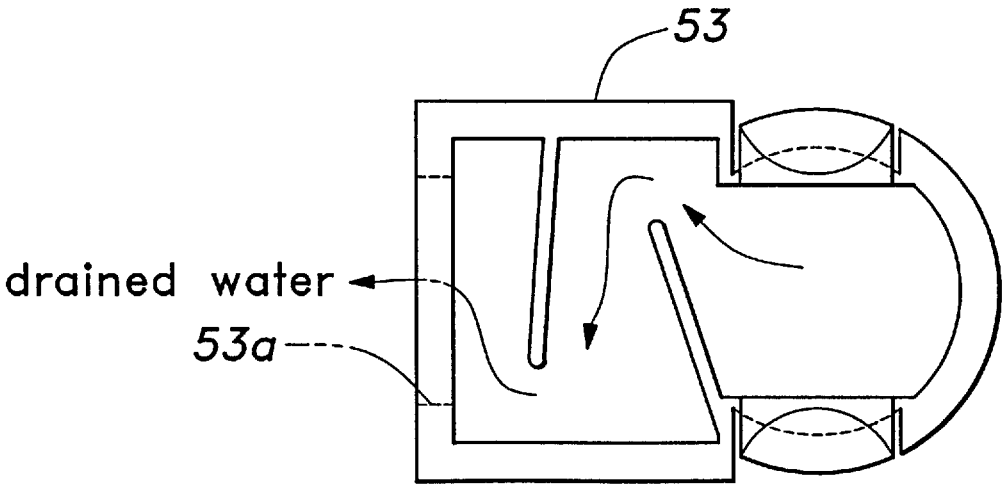
FIG. 6 is an enlarged top plan view of a drainage cap member for a motor.

The drainage cap member 53 has, as clearly shown in FIG. 6 illustrating the top plan view thereof, a pair of flexible engagement pieces which are pressed into the drain hole 44*a* formed in the motor casing 44, and a labyrinth structure is formed therein by a plurality of walls so as to allow water to flow from the drain hole 44*a* to the outside but prevent water, which may be splashed toward the drain hole 44*a* for example when the vehicle travels over puddles, from directly reaching the drain hole 44*a*.

It should be noted that the outlet opening 53*a* of the drainage cap member 53 and that of the drain channel 51 are arranged so that they face each other. In this way, travel of water toward the drain channel 51 from outside is blocked by the drainage cap member 53 and therefore the prevention of the intrusion of water into the drain channel 51 can be achieved even more effectively. As show in FIG. 2, the drain channel 51 is formed in a projecting portion 17*a* of the pinion housing 17 which projects from a standard outer circumferential line of the pinion housing 17. This projecting portion 17*a* also contributes to preventing water from entering the outlet opening 53*a* of the drainage cap member 53.

Although in the above embodiment the starter was shown as being one in that the solenoid device 9 used as a driving source of the shift mechanism for displacing the pinion 6 was disposed coaxially with respect to the electric motor 3, the present invention should not be limited to this embodiment. The present invention can be applied to various kinds of is engine starters, such as that in which the solenoid device is disposed on a side of the electric motor and the pinion is displaced via a shift lever, or in which the solenoid device is not provided and the pinion is caused to slide by the inertia drive, as long as the starters comprise a planetary gear reduction gear unit.

Thus, according to the present invention, a labyrinth structure for favorably preventing intrusion of water into the drain channel provided to the shift chamber casing can be formed by using conventional component parts without using additional parts such as a drain cover or a labyrinth tube, and such a simplified structure can contribute to reducing the cost of the starter. By arranging the drain channel and the motor drainage cap member so that their outlet openings face each other, the intrusion of water into each of them can be prevented even more effectively.

Although the present invention has been described in terms of preferred embodiments thereof, it is obvious to a person skilled in the art that various alterations and modifications are possible without departing from the scope of the present invention which is set forth in the appended claims.

What we claim is:

1. A starter for an internal combustion engine, comprising:

an electric motor having a rotor shaft;

an output shaft;

a pinion fitted on the output shaft and coupled with said output shaft via a spline;

a reduction gear unit for transmitting an output of the electric motor to the output shaft, the reduction gear unit comprising a sun gear which is formed in a part of the rotor shaft, a plurality of planetary gears meshing with the sun gear, and an internal teeth ring gear meshing with the planetary gears;

shift means to drive the pinion into mesh with a ring gear of the internal combustion engine;

a housing for accommodating at least the reduction gear unit, the housing having an opening facing the electric motor;

a top plate defining a first annular member fitted into the opening of the housing, said internal teeth ring gear of the reduction gear unit provided along an inner periphery of the first annular member; and a recess formed at a lower part of the housing in an installed state of the starter in a manner that the recess is formed in an inner periphery of the housing so as to define a drain passage extending substantially axially, wherein a part of an outer periphery of the first annular member protrudes into the recess.

2. A starter according to claim 1, wherein a second annular member is disposed between the electric motor and the first annular member for separating the electric motor and the reduction gear unit from each other, and said protruding part of the outer periphery of the first annular member is formed with an extension axially extending toward the electric motor so as to cover a lower part of a joint between the first and second annular members.

3. A starter according to claim 1, wherein the starter further comprises a motor casing for accommodating the electric motor, and the motor casing is provided with a projection at a lower part thereof in the starter's installed state such that the projection contributes to preventing water's intrusion from outside into said drain passage formed in the inner periphery of the housing.

4. A starter according to claim 3, wherein said protrusion of the motor casing consists of a cap member for covering a drain hole which is formed at a lower part of the motor casing in the starter's installed state, and an outlet opening of said cap member and that of said drain passage defined by the recess are arranged such that they face each other.

5. A starter according to claim 4, wherein said housing comprises a projecting portion at a lower part thereof in the starter's installed state, and the recess defining the drain passage is formed in said projecting portion.

6. A starter according to claim 1, wherein the first annular member is made of a synthetic resin material.

* * * * *